US008447594B2

(12) United States Patent
Massimino et al.

(10) Patent No.: US 8,447,594 B2
(45) Date of Patent: May 21, 2013

(54) MULTICODEBOOK SOURCE-DEPENDENT CODING AND DECODING

(75) Inventors: Paolo Massimino, Turin (IT); Paolo Coppo, Turin (IT); Marco Vecchietti, Turin (IT)

(73) Assignee: Loquendo S.p.A., Turin (IT)

( * ) Notice: Subject to any disclaimer, the term of this patent is extended or adjusted under 35 U.S.C. 154(b) by 1027 days.

(21) Appl. No.: 12/312,818

(22) PCT Filed: Nov. 29, 2006

(86) PCT No.: PCT/EP2006/011431

§ 371 (c)(1),
(2), (4) Date: May 28, 2009

(87) PCT Pub. No.: WO2008/064697

PCT Pub. Date: Jun. 5, 2008

(65) Prior Publication Data

US 2010/0057448 A1 Mar. 4, 2010

(51) Int. Cl.
*G10L 19/12* (2006.01)

(52) U.S. Cl.
USPC ..... 704/222

(58) Field of Classification Search
USPC ..... 704/219–223, 230
See application file for complete search history.

(56) References Cited

U.S. PATENT DOCUMENTS

| | | | | |
|---|---|---|---|---|
| 6,104,992 | A * | 8/2000 | Gao et al. | 704/220 |
| 6,173,257 | B1 * | 1/2001 | Gao | 704/220 |
| 6,188,980 | B1 * | 2/2001 | Thyssen | 704/230 |
| 6,260,010 | B1 * | 7/2001 | Gao et al. | 704/230 |
| 6,330,533 | B2 * | 12/2001 | Su et al. | 704/220 |
| 6,385,573 | B1 * | 5/2002 | Gao et al. | 704/220 |
| 6,449,590 | B1 * | 9/2002 | Gao | 704/219 |
| 6,480,822 | B2 * | 11/2002 | Thyssen | 704/220 |
| 6,493,665 | B1 * | 12/2002 | Su et al. | 704/230 |
| 6,507,814 | B1 * | 1/2003 | Gao | 704/220 |
| 6,581,031 | B1 * | 6/2003 | Ito et al. | 704/222 |

(Continued)

FOREIGN PATENT DOCUMENTS

| | | |
|---|---|---|
| WO | WO-99/59137 | 11/1999 |
| WO | WO-00/16485 | 3/2000 |

OTHER PUBLICATIONS

Kanungo et al.; "An Efficent *k*-Means Clustering Algorithm: Analysis and Implementation"; IEEE Transactions on Pattern Analysis and Machine Intelligence, vol. 24, No.7, pp. 881-892, (2002).

Chu, Speech Coding Algorithms, Wiley Interscience, "Code-Excited Linear Prediction", pp. 299-324, (2003).

Hagen et al.; "Variable Rate Spectral Quantization for Phonetically Classified Celp Coding", Accoustics, Speech, and Signal Processing. vol. 1. pp. 748-751, (1995).

(Continued)

*Primary Examiner* — Abul Azad
(74) *Attorney, Agent, or Firm* — Hamilton, Brook, Smith & Reynolds, P.C.

(57) ABSTRACT

A method for coding data, includes: grouping data into frames; classifying the frames into classes; for each class, transforming the frames belonging to the class into filter parameter vectors, which are extracted from the frames by applying a first mathematical transformation; for each class, computing a filter codebook based on the filter parameter vectors belonging to the class; segmenting each frame into subframes; for each class, transforming the subframes belonging to the class into source parameter vectors, which are extracted from the subframes by applying a second mathematical transformation based on the filter codebook computed for the corresponding class; for each class, computing a source codebook based on the source parameter vectors belonging to the class; and coding the data based on the computed filter and source codebooks.

25 Claims, 5 Drawing Sheets

U.S. PATENT DOCUMENTS

| | | | | |
|---|---|---|---|---|
| 6,813,602 | B2 * | 11/2004 | Thyssen | 704/222 |
| 6,978,235 | B1 * | 12/2005 | Ozawa | 704/219 |
| 7,177,804 | B2 * | 2/2007 | Wang et al. | 704/219 |
| 7,280,960 | B2 * | 10/2007 | Wang et al. | 704/219 |
| 7,734,465 | B2 * | 6/2010 | Wang et al. | 704/219 |
| 7,904,293 | B2 * | 3/2011 | Wang et al. | 704/222 |
| 2005/0096901 | A1 | 5/2005 | Uvliden et al. | |
| 2005/0197833 | A1 | 9/2005 | Yasunaga et al. | |
| 2006/0206317 | A1 | 9/2006 | Morii et al. | |
| 2006/0271355 | A1 * | 11/2006 | Wang et al. | 704/220 |
| 2006/0271357 | A1 * | 11/2006 | Wang et al. | 704/223 |
| 2008/0040105 | A1 * | 2/2008 | Wang et al. | 704/221 |
| 2008/0040121 | A1 * | 2/2008 | Wang et al. | 704/500 |
| 2009/0248404 | A1 * | 10/2009 | Ehara et al. | 704/219 |
| 2010/0057448 | A1 * | 3/2010 | Massimino et al. | 704/222 |

OTHER PUBLICATIONS

Xydeas et al., "Multi Codebook Vector Quantization of LPC Parameters", Acoustics, Speech, and Signal Processing, vol. 1, pp. 61-64, (1998).

Hernandez-Gomez et al., "Phonetically-Driven Celp Coding Using Self-Organizing Maps", Statistical Signal and Array Processing, vol. 4, pp. II-628-II-631, ((1993).

Morishima et al., "A Very Low Bit Rate Speech Coding Based on a Phoneme Recognition", Proceedings of the International Symposium on Information Theory (ISIT), pp. 71-72, (1988).

Chu, Speech Coding Algorithms, Wiley Interscience, "The Levinson-Durbin Algorithm", pp. 107-114, (2003).

* cited by examiner

MULTICODEBOOK SOURCE-DEPENDENT CODING AND DECODING

CROSS REFERENCE TO RELATED APPLICATION

This application is a national phase application based on PCT/EP2006/011431, filed Nov. 29, 2006.

TECHNICAL FIELD OF THE INVENTION

The present invention relates in general to signal coding, and in particular to speech/audio signal coding. More in detail, the present invention relates to coding and decoding of speech/audio signal via the modeling of a variable number of codebooks, proportioning the quality of the reconstructed signal and occupation of memory/transmission bandwidth. The present invention find an advantageous, but not exclusive, application in speech synthesis, in particular corpus-based speech synthesis, where the source signal is known a priori, to which the following description will refer without this implying any loss of generality.

BACKGROUND ART

In the field of speech synthesis, in particular based on the concatenation of sound segments for making up the desired phrase, the demand arises to represent the sound material used in the synthesis process in a compact manner. Code Excited Linear Prediction (CELP) is a well-known technique for representing a speech signal in a compact manner, and is characterized by the adoption of a method, known as Analysis by Synthesis (A-b-S), that consists in separating the speech signal into excitation and vocal tract components, coding the excitation and linear prediction coefficients (LPCs) for the vocal tract component using an index that points to a series of representations stored in a codebook. The selection of the best index for the excitation and for the vocal tract is chosen by comparing the original signal with the reconstructed signal. For a complete description of the CELP technique reference may be made to Wai C. Chu, *Speech Coding Algorithms*, ISBN 0-471-37312-5, p. 299-324. Modified versions of the CELP are instead disclosed in US 2005/197833, US 2005/096901, and US2006/206317. FIG. 1 shows a block diagram of the CELP technique for speech signal coding, where the vocal tract and the glottal source are modeled by an impulse source (excitation), referenced by F1-1, and by a variant-time digital filter (synthesis filter), referenced by F1-2.

OBJECT AND SUMMARY OF THE INVENTION

The Applicant has noticed that in general in the known methods the excitation and the vocal tract components are speaker-independently modeled, thus leading to a speech signal coding with a reduced memory occupation of the original signal. On the other hand, the Applicant has also noticed that the application of this type of modeling causes the imperfect reconstruction of the original signal: in fact, the smaller the memory occupation, the greater is the degradation of the reconstructed signal with respect to the original signal. This type of coding takes the name of lossy coding (in the sense of information loss). In other words, the Applicant has noticed that the codebook from which the best excitation index is chosen and the codebook from which the best vocal tract model is chosen do not vary on the basis of the speech signal that it is intended to code, but are fixed and independent of the speech signal, and that this characteristic limits the possibility of obtaining better representations of the speech signal, because the codebooks utilized are constructed to work for a multitude of voices and are not optimized for the characteristics of an individual voice.

The objective of the present invention is therefore to provide an effective and efficient source-dependent coding and decoding technique, which allows a better proportion between the quality of the reconstructed signal and the memory occupation/transmission bandwidth to be achieved with respect to the known source-independent coding and decoding techniques.

This object is achieved by the present invention in that it relates to a coding method, a decoding method, a coder, a decoder and software products as defined in the appended claims.

The present invention achieves the aforementioned objective by contemplating a definition of a degree of approximation in the representation of the source signal in the coded form based on the desired reduction in the memory occupation or the available transmission bandwidth. In particular, the present invention includes grouping data into frames; classifying the frames into classes; for each class, transforming the frames belonging to the class into filter parameter vectors; for each class, computing a filter codebook based on the filter parameter vectors belonging to the class; segmenting each frame into subframes; for each class, transforming the subframes belonging to the class into source parameter vectors, which are extracted from the subframes by applying a filtering transformation based on the filter codebook computed for the corresponding class; for each class, computing a source codebook based on the source parameter vectors belonging to the class; and coding the data based on the computed filter and source codebooks.

The term class identifies herein a category of basic audible units or sub-units of a language, such as phonemes, demiphones, diphones, etc.

According to a first aspect, the invention refers to a method for coding audio data, comprising:

- grouping data into frames;
- classifying the frames into classes;
- for each class, transforming the frames belonging to the class into filter parameter vectors;
- for each class, computing a filter codebook based on the filter parameter vectors belonging to the class;
- segmenting each frame into subframes;
- for each class, transforming the subframes belonging to the class into source parameter vectors, which are extracted from the subframes by applying a filtering transformation based on the filter codebook computed for the corresponding class;
- for each class, computing a source codebook based on the source parameter vectors belonging to the class; and
- coding the data based on the computed filter and source codebooks.

The data may be samples of a speech signal, and the classes may be phonetic classes, e.g. demiphone or fractions of demiphone classes.

Classifying the frames into classes may include:

- if the cardinality of a class satisfies a given classification criterion, associating the frames with the class;
- if the cardinality of a class does not satisfy the given classification criterion, further associating the frames with subclasses to achieve a uniform distribution of the cardinality of the subclasses.

The data may be samples of a speech signal, the filter parameter vectors extracted from the frames may be such as to model a vocal tract of a speaker, and the filter parameter vectors may be linear prediction coefficients.

Transforming the frames belonging to a class into filter parameter vectors may include carrying out a Levinson-Durbin algorithm.

The step of computing a filter codebook for each class based on the filter parameter vectors belonging to the class may include:

computing specific filter parameter vectors which minimize the global distance between themselves and the filter parameter vectors in the class, and based on a given distance metric; and computing the filter codebook based on the specific filter parameter vectors, wherein the distance metric depends on the class to which each filter parameter vector belongs; or the distance metric may be the Euclidian distance defined for an N-dimensional vector space.

The specific filter parameter vectors may be centroid filter parameter vectors computed by applying a k-means clustering algorithm, and the filter codebook may be formed by the specific filter parameter vectors.

The step of segmenting each frame into subframes may include:

defining a second sample analysis window as a sub-multiple of the width of the first sample analysis window; and segmenting each frame into a number of subframes correlated to the ratio between the widths of the first and second sample analysis windows, wherein the ratio between the widths of the first and second sample analysis windows ranges from four to five.

The step of computing a source codebook for each class based on the source parameter vectors belonging to the class may include:

computing specific source parameter vectors which minimize the global distance between themselves and the source parameter vectors in the class, and based on a given distance metric; and computing the source codebook based on the specific source parameter vectors, wherein the distance metric depends on the class to which each source parameter vector belongs.

The distance metric may be the Euclidian distance defined for an N-dimensional vector space.

The specific source parameter vectors may be centroid source parameter vectors computed by applying a k-means clustering algorithm, and the source codebook may be formed by the specific source parameter vectors.

The step of coding the data based on the computed filter and source codebooks may include:

associating with each frame indices that identify a filter parameter vector in the filter codebook and source parameter vectors in the source codebook that represent the samples in the frame and respectively in the respective subframes.

BRIEF DESCRIPTION OF THE DRAWINGS

For a better understanding of the present invention, a preferred embodiment, which is intended purely by way of example and is not to be construed as limiting, will now be described with reference to the attached drawings, wherein.

DETAILED DESCRIPTION OF PREFERRED EMBODIMENTS OF THE INVENTION

The following description is presented to enable a person skilled in the art to make and use the invention. Various modifications to the embodiments will be readily apparent to those skilled in the art, and the generic principles herein may be applied to other embodiments and applications without departing from the spirit and scope of the present invention. Thus, the present invention is not intended to be limited to the embodiments shown, but is to be accorded the widest scope consistent with the principles and features disclosed herein and defined in the attached claims.

In addition, the present invention is implemented by means of a computer program product including software code portions for implementing, when the computer program product is loaded in a memory of the processing system and run on the processing system, a coding and decoding method, as described hereinafter with reference to FIGS. 2 to 9.

Additionally, a method will now be described to represent and compact a set of data, not necessarily belonging to the same type (for example, the lossy compression of a speech signal originating from multiple sources and/or a musical signal). The method finds advantageous, but not exclusive application to data containing information regarding digital speech and/or music signals, where the individual data item corresponds to a single digital sample.

Figure 2:
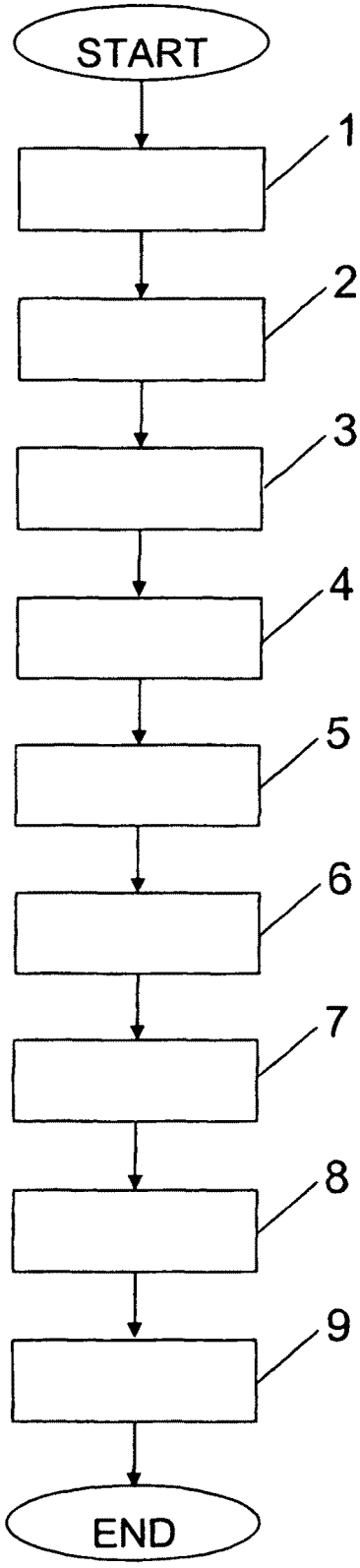
FIG. 2 shows a flowchart of the method according to the present invention.

With reference to the flowchart shown in FIG. 2, the method according to the present invention provides for eight data-processing steps to achieve the coded representation and one step for reconstructing the initial data, and in particular:

1. Classification and grouping of data into classes (block 1);

2. Selection of a first data analysis window, i.e. the number of consecutive data items that must be considered as a single information unit, hereinafter referred to as frame, for the next step (block 2);

3. Transformation, for each identified class, of the frames identified in the previous step and belonging to the class under consideration, into filter parameters (block 3);

4. Computation, for each identified class, of a set of N parameters globally representing synthesis filter information units belonging to the class under consideration, and storing the extracted parameters in a codebook hereinafter referred to as Filter Codebook (block 4);

5. Selection of a second data analysis window, i.e. the number of consecutive data items that are considered as a single information unit for the next step (block 5);

6. Extraction, for each identified class, of source parameters using the corresponding Filter Codebook as the model: this decomposition differs from the transformation in previous step 3 in the dependence on the Filter Codebook, not present in step 3, and in the different analysis window definition (block 6);

7. Computation, for each identified class, of a set of N parameters globally representing the source data belonging to class under consideration, and storing the extracted values in a codebook hereinafter referred to as Source Codebook (block 7);

8. Data coding (block 8); and

9. Data decoding (block 9).

Hereinafter each individual data-processing step will be described in detail.

1. Classification and Grouping of Data

Figure 3:
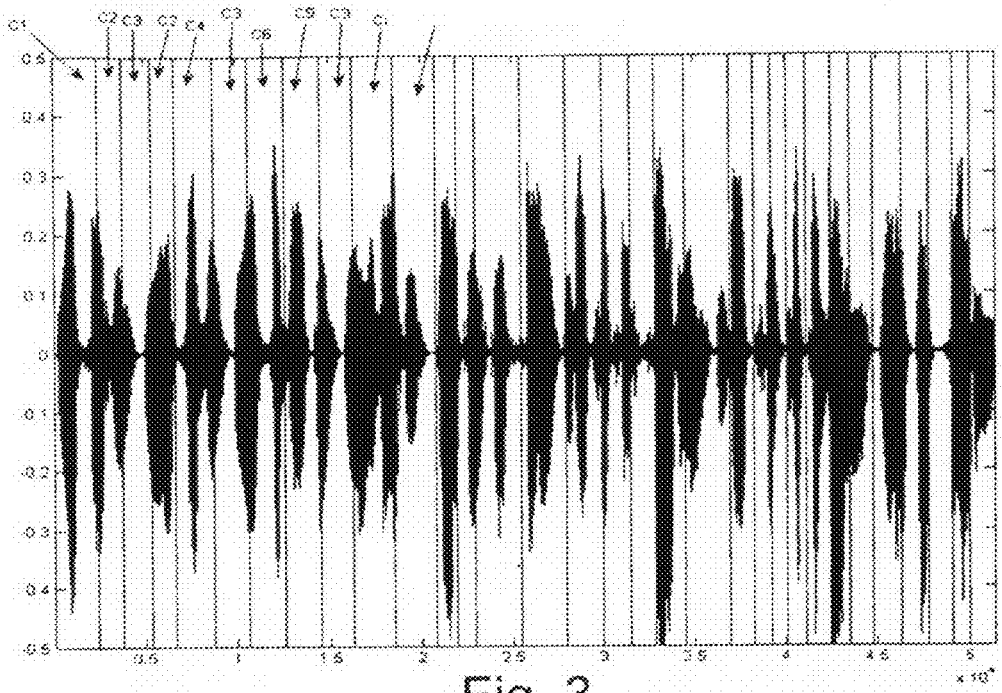
FIGS. 3 and 4 show a speech signal and quantities involved in the method of the present invention.

In this step, the available data is grouped into classes for subsequent analysis. Classes that represent the phonetic content of the signal can be identified in the speech signal. In general, data groups that satisfy a given metric are identified. One possible choice may be the subdivision of the available data into predefined phonetic classes. A different choice may be the subdivision of the available data into predefined demiphone classes. The chosen strategy is a mix of these two strategies. This step provides for subdivision of the available data into phonemes if the number of data items belonging to the class is below a given threshold. If instead the threshold is exceeded, a successive subdivision into demiphone subclasses is performed on the classes that exceed the threshold. The subdivision procedure can be iterated a number of times on the subclasses that have a number of elements greater than the threshold, which may vary at each iteration and may be defined to achieve a uniform distribution of the cardinality of the classes. To achieve this goal, right and left demiphones, or in general fractions of demiphones, may for example be identified and a further classification may be carried out based on these two classes. FIG. 3 shows a speech signal and the classification and the grouping described above, where the identified classes are indicated as Ci with $1 \leqq i \leqq N$, wherein N is the total number of classes.

2. Selection of the First Data Analysis Window

Figure 4:
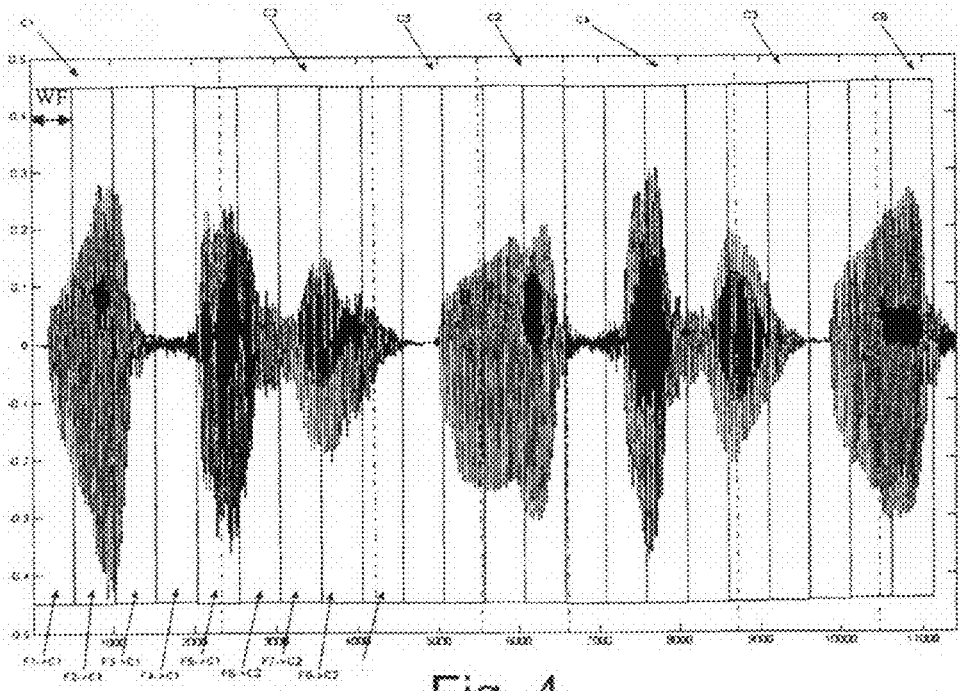

In this step, a sample analysis window WF is defined for the subsequent coding. For a speech signal, a window that corresponds to 10-30 milliseconds can be chosen. The samples are segmented into frames that contain a number of samples equal to the width of the window. Each frame belongs to one class only. In cases of a frame overlapping several classes, a distance metric may be defined and the frame assigned to the nearest class. The selection criteria for determining the optimal analysis window width depends on the desired sample representation detail. The smaller the analysis window width, the greater the sample representation detail and the greater the memory occupation, and vice versa. FIG. 4 shows a speech signal with the sample analysis window WF, the frames Fi, and the classes Ci, wherein each frame belongs to one class only.

3. Transformation of the Frames into Filter Parameter Vectors

Figure 1:
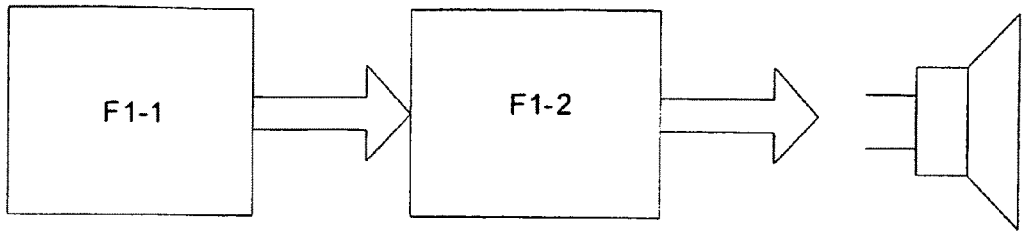
FIG. 1 shows a block diagram representing the CELP technique for speech signal coding.
Figure 5:
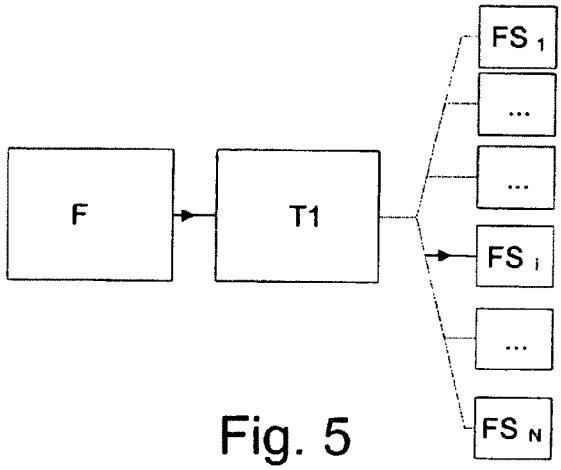
FIG. 5 shows a block diagram of a transformation of frames into codevectors.

In this step, the transformation of each frame into a corresponding filter parameter vector, generally know as codevector, is carried out through the application of a mathematical transformation T1. In the case of a speech signal, the transformation is applied to each frame so as to extract from the speech signal contained in the frame a codevector modeling the vocal tract and made up of LPCs or equivalent parameters. An algorithm to achieve this decomposition is the Levinson-Durbin algorithm described in the aforementioned Wai C. Chu, *Speech Coding Algorithms*, ISBN 0-471-37312-5, p. 107-114. In particular, in the previous step 2, each frame has been tagged as belonging to a class. In particular, the result of the transformation of a single frame belonging to a class is a set of synthesis filter parameters forming a codevector FSi ($1<i<N$), which belongs to the same class as the corresponding frame. For each class, a set of codevectors FS is hence generated with the values obtained by applying the transformation to the corresponding frames F. The number of codevectors FS is not generally the same in all classes, due to the different number of frames in each class. The transformation applied to the samples in the frames can vary as a function of the class to which they belong, in order to maximize the matching of the created model to the real data, and as a function of the information content of each single frame. FIG. 5 shows a block diagram representing the transformation T1 of the frames F into respective codevectors FS.

4. Generation of Filter Codebooks

In this step, for each class, a number X of codevectors, hereinafter referred to as centroid codevectors CF, are computed which minimize the global distance between themselves and the codevectors FS in the class under consideration. The definition of the distance may vary depending on the class to which the codevectors FS belong. A possible applicable distance is the Euclidian distance defined for vector spaces of N dimensions. To obtain the centroid codevectors, it is possible to apply, for example, an algorithm known as k-means algorithm (see *An Efficient k-Means Clustering Algorithm: Analysis and Implementation*, IEEE transactions on pattern analysis and machine intelligence, vol. 24, no. 7, July 2002, p. 881-892). The extracted centroid codevectors CF forms a so-called filter codebook for the corresponding class, and the number X of centroid codevectors CF for each class is based on the coded sample representation detail. The greater the number X of centroid codevectors for each class, the greater the coded sample representation detail and the memory occupation or transmission bandwidth required.

5. Selection of the Second Data Analysis Window

Figure 6:
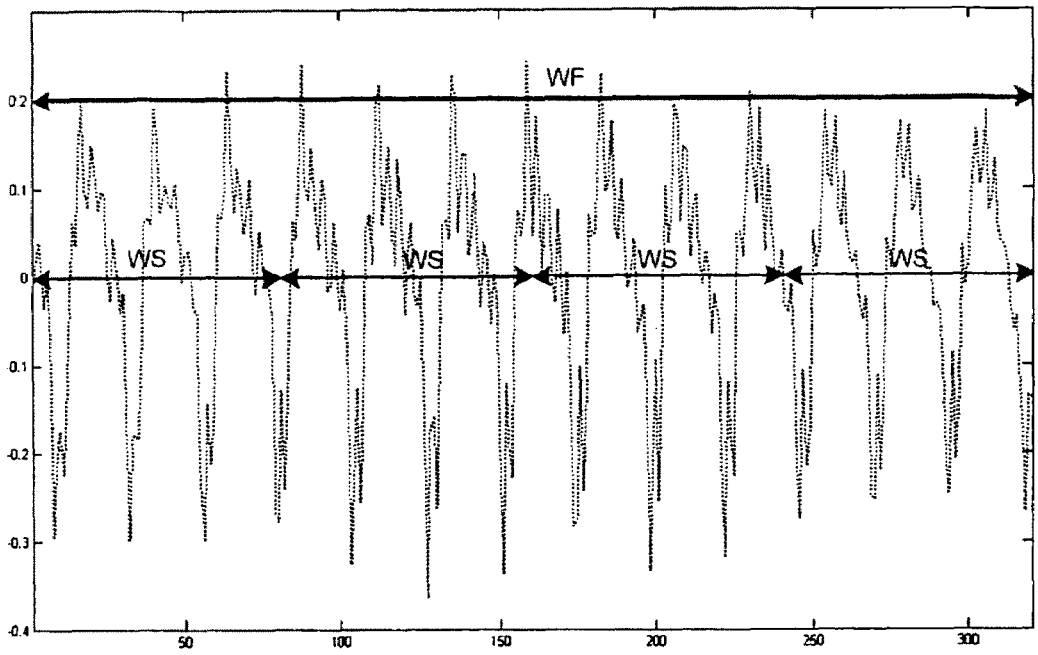
FIG. 6 shows another speech signal and quantities involved in the method of the present invention.

In this step, based on a predefined criterion, an analysis window WS for the next step is determined as a sub-multiple of the width of the WF window determined in the previous step 2. The criterion for optimally determining the width of the analysis window depends on the desired data representation detail. The smaller the analysis window, the greater the representation detail of the coded data and the greater the memory occupation of the coded data, and vice versa. The analysis window is applied to each frame, in this way generating n subframes for each frame. The number n of subframes depends on the ratio between the widths of the windows WS and WF. A good choice for the WS window may be from one quarter to one fifth the width of the WF window. FIG. 6 shows a speech signal along with the sample analysis windows WF and WS.

6. Extraction of Source Parameters Using the Filter Codebooks

Figure 7:
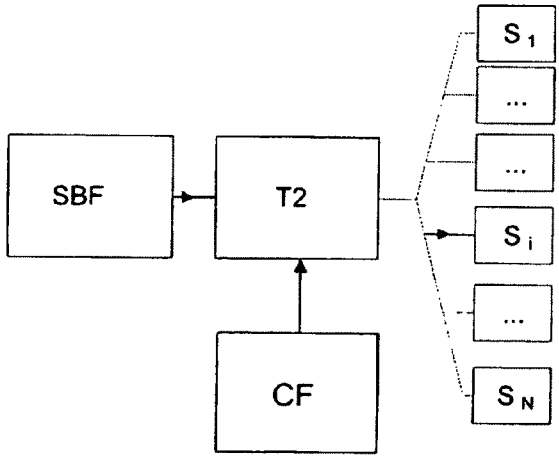
FIG. 7 shows a block diagram of a transformation of subframes into source parameters.

In this step, the transformation of each subframe into a respective source parameter vector Si is carried out through the application of a filtering transformation T2 which is, in practice, an inverse filtering function based on the previously computed filter codebook. In the case of a speech signal, the inverse filtering is applied to each subframe so as to extract from the speech signal contained in the subframe, based on the filter codebook CF, a set of source parameters modeling the excitation signal. The source parameter vectors so computed are then grouped into classes, similarly to what previously described with reference to the frames. For each class Ci, a corresponding set of source parameter vectors S is hence generated. FIG. 7 shows a block diagram representing the transformation T2 of the subframes SBF into source parameters $S_i$ based on the filter codebook CF.

7. Generation of Source Codebooks

In this step, for each class C, a number Y of source parameter vectors, hereinafter referred to as source parameter centroids CSi, are computed which minimize the global distance between themselves and the source parameter vectors in the class under consideration. The definition of the distance may vary depending on the class to which the source parameter vectors S belongs. A possible applicable distance is the Euclidian distance defined for vector spaces of N dimensions. To obtain the source parameter centroids, it is possible to apply, for example, the previously mentioned k-means algorithm. The extracted source parameter centroids forms a source codebook for the corresponding class, and the number Y of source parameter centroids for each class is based on the representation detail of the coded samples. The greater the number Y of source parameter centroids for each class, the greater the representation detail and the memory occupation/transmission bandwidth. At the end of this step, a filter codebook and a source codebook are so generated for each class, wherein the filter codebooks represent the data obtained from analysis via the WF window and the associated transformation, and the source codebooks represent the data obtained from analysis via the WS window and the associated transformation (dependent on the filter codebooks.

8. Coding

Figure 8:
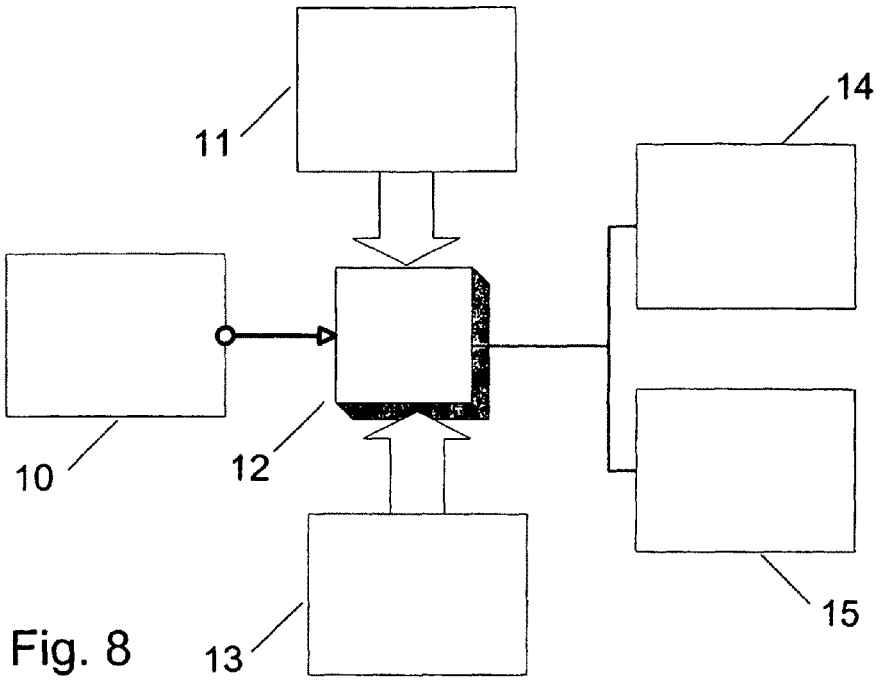
FIG. 8 shows a block diagram of a coding phase.

The coding is carried out by applying the aforementioned CELP method, with the difference that each frame is associated with a vector of indices that specify the centroid filter parameter vectors and the centroid source parameter vectors that represent the samples contained in the frame and in the respective subframes to be coded. Selection is made by applying a pre-identified distance metric and choosing the centroid filter parameter vectors and the centroid source parameter vectors that minimize the distance between the original speech signal and the reconstructed speech signal or the distance between the original speech signal weighted with a function that models the ear perceptive curve and the reconstructed speech signal weighted with the same ear perceptive curve. The filter and source codebooks CF and CS are stored so that they can be used in the decoding phase. FIG. 8 shows a block diagram of the coding phase, wherein 10 designates the frame to code, which belongs to the i-th class, 11 designates the i-th filter codebook CFi, i.e., the filter codebook associated with the i-th class to which the frame belongs, 12 designate the coder, 13 designates the i-th source codebook CSi, i.e., the source codebook associated with the i-th class to which the frame belongs, 14 designates the index of the best filter codevector of the i-th filter codebook CFi, and 15 designates the indices of best source codevectors of the i-th source codebook CSi.

9. Decoding

Figure 9:
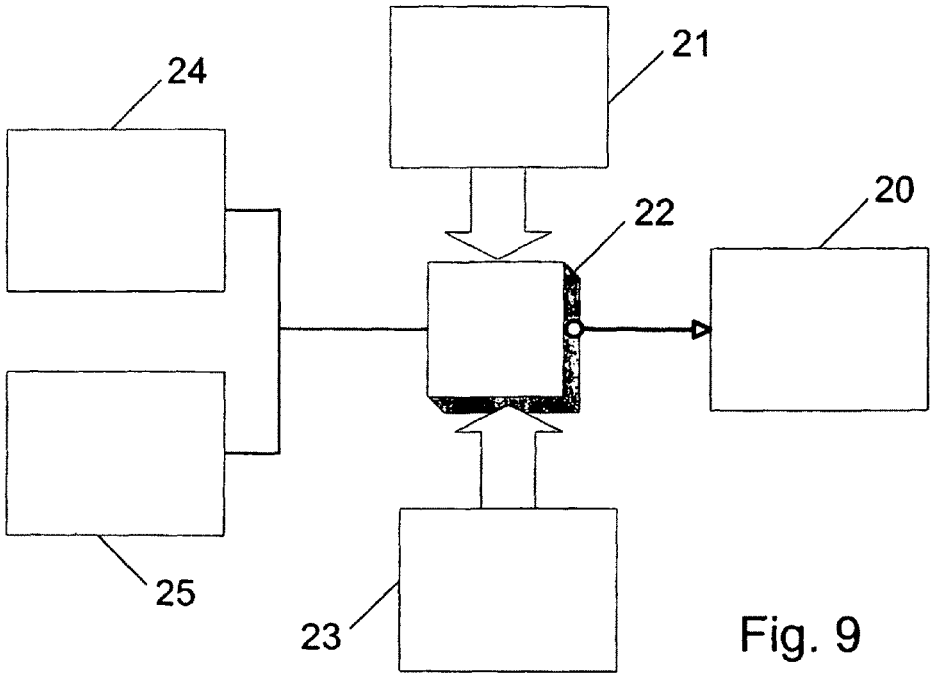
FIG. 9 shows a block diagram of a decoding phase.

In this step, reconstruction of the frames is carried out by applying the inverse transformation applied during the coding phase. For each frame and for each corresponding subframe, the indices of the filter codevector and of the source codevectors belonging to filter and source codebooks CF ad CS that code for the frames and subframes is read and an approximated version of the frames is reconstructed, applying the inverse transformation. FIG. 9 shows a block diagram of the decoding phase, wherein 20 designates the decoded frame, which belongs to the i-th class, 21 designates the i-th filter codebook CFi, i.e., the filter codebook associated with the i-th class to which the frame belongs, 22 designates the decoder, 23 designates the i-th source codebook CSi, i.e., the source codebook associated with the i-th class to which the frame belongs, 24 designates the index of the best filter codevector of the i-th filter codebook CFi, and 25 designates the indices of the best source codevectors of the i-th source codebook CSi.

The advantages of the present invention are evident from the foregoing description. In particular, the choice of the codevectors, the cardinality of the single codebook and the number of codebooks based on the source signal, as well as the choice of coding techniques dependent on knowledge of the informational content of the source signal allow better quality to be achieved for the reconstructed signal for the same memory occupation/transmission bandwidth by the coded signal, or a quality of reconstructed signal to be achieved that is equivalent to that of coding methods requiring greater memory occupation/transmission bandwidth.

Finally, it is clear that numerous modifications and variants can be made to the present invention, all falling within the scope of the invention, as defined in the appended claims.

In particular, it may be appreciated that the present invention may also be applied to the coding of signals other than those utilized for the generation of the filter and source codebooks CF and CS. In this respect, it is necessary to modify step 8 because the class to which the frame under consideration belongs is not known a priori. The modification therefore provides for the execution of a cycle of measurements for the best codevector using all of the N precomputed codebooks, in this way determining the class to which the frame to be coded belongs: the class to which it belongs is the one that contains the codevector with the shortest distance. In this application, an Automatic Speech Recognition (ASR) system may also be exploited to support the choice of the codebook, in the sense that the ASR is used to provide the phoneme, and then only the classes associated with that specific phoneme are considered.

Additionally, the coding bitrate has not necessarily to be the same for the whole speech signal to code, but in general different stretches of the speech signal may be coded with different bitrate. For example, stretches of the speech signal more frequently used in text-to-speech applications could be coded with a higher bitrate, i.e. using filter and/or source codebooks with higher cardinality, while stretches of the speech signal less frequently used could be coded with a lower bitrate, i.e. using filter and/or source codebooks with lower cardinality, so as to obtain a better speech reconstruction quality for those stretches of the speech signal more frequently used, so increasing the overall perceived quality.

Additionally, the present invention may also be used in particular scenarios such as remote and/or distributed Text-To-Speech (TTS) applications, and Voice over IP (VoIP) applications.

In particular, the speech is synthesized in a server, compressed using the described method, remotely transmitted, via an Internet Protocol (IP) channel (e.g. GPRS), to a mobile device such as a phone or Personal Digital Assistant (PDA), where the synthesized speech is first decompressed and then played. In particular, a speech database, in general a considerable portion of speech signal, is non-real-time pre-processed to create the codebooks, the phonetic string of the text to be synthesized is real-time generated during the synthesis process, e.g. by means of an automatic speech recognition process, the signal to be synthesized is real-time generated from the uncompressed database, then real-time coded in the server, based on the created codebooks, transmitted to the mobile device in coded form via the IP channel, and finally the coded signal is real-time decoded in the mobile device and the speech signal is finally reconstructed.

The invention claimed is:

1. A method for coding audio data, comprising:

grouping data into frames;

classifying the frames into classes;

for each class, transforming the frames belonging to the class into filter parameter vectors;

for each class, computing a filter codebook based on the filter parameter vectors belonging to the class;

segmenting each frame into subframes;

for each class, transforming the subframes belonging to the class into source parameter vectors, which are extracted from the subframes by applying a filtering transformation based on the filter codebook computed for a corresponding class;

for each class, computing a source codebook based on the source parameter vectors belonging to the class; and coding the data based on the computed filter and source codebooks.

2. The method of claim 1, wherein the data are samples of a speech signal, and wherein the classes are phonetic classes.

3. The method of claim 1, wherein classifying the frames into classes comprises:

if the cardinality of a class satisfies a given classification criterion, associating the frames with the class; and if the cardinality of a class does not satisfy the given classification criterion, further associating the frames with subclasses to achieve a uniform distribution of the cardinality of the subclasses.

4. The method of claim 3, wherein the classification criterion is defined by a condition that the cardinality of the class is below a given threshold.

5. The method of claim 3, wherein the data are samples of a speech signal, and wherein the classes are phonetic classes and the subclasses are demiphone classes.

6. The method of claim 1, wherein said filtering transformation is an inverse filtering function based on a previously computed filter codebook.

7. The method of claim 1, wherein the data are samples of a speech signal and wherein grouping data into frames comprises:

defining a sample analysis window; and grouping the samples into frames, each containing a number of samples equal to the width of the first analysis window, wherein classifying the frames into classes comprises:

classifying each frame into one class only, and if a frame overlaps several classes, classifying the frame into a nearest class according to a given distance metric.

8. The method of claim 1, wherein computing a filter codebook for each class based on the filter parameter vectors belonging to the class comprises:

computing specific filter parameter vectors which minimize global distance between themselves and the filter parameter vectors in the class, and based on a given distance metric; and computing the filter codebook based on the specific filter parameter vectors.

9. The method of claim 8, wherein the distance metric depends on the class to which each filter parameter vector belongs.

10. The method of claim 1, wherein segmenting each frame into subframes comprises:

defining a second sample analysis window as a sub-multiple of a width of a first sample analysis window; and segmenting each frame into a number of subframes correlated to a ratio between the widths of the first and second sample analysis windows.

11. The method of claim 1, wherein the data are samples of a speech signal, and wherein the source parameter vectors extracted from the subframes are such as to model an excitation signal of a speaker.

12. The method of claim 11, wherein the filtering transformation is applied to a number of subframes correlated to a ratio between widths of a first and a second sample analysis windows.

13. The method of claim 1, wherein computing a source codebook for each class based on the source parameter vectors belonging to the class comprises:

computing specific source parameter vectors which minimize a global distance between the specific source parameter vectors and the source parameter vectors in the class, and based on a given distance metric; and computing the source codebook based on the specific source parameter vectors.

14. The method of claim 1, wherein coding the data based on the computed filter and source codebooks comprises:

associating with each frame indices that identify a filter parameter vector in the filter codebook and source parameter vectors in the source codebook that represent samples in the frame and respectively in respective subframes.

15. The method of claim 14, wherein associating with each frame indices that identify a filter parameter vector in the filter codebook and source parameter vectors in the source codebook that represent the samples in the frame and in the respective subframes comprises:

defining a distance metric; and choosing the nearest filter parameter vector and the source parameter vectors based on the defined distance metric.

16. The method of claim 15, wherein choosing the nearest filter parameter vector and the source parameter vectors based on the defined distance metric comprises:

choosing the filter parameter vector and the source parameter vectors that minimize a distance between original data and reconstructured data.

17. The method of claim 16, wherein the data are samples of a speech signal, and wherein choosing the nearest filter parameter vector and the source parameter vectors based on the defined distance metric comprises:

choosing the filter parameter vector and the source parameter vectors that minimize a distance between a original speech signal weighted with a function that models ear perceptive curve and a reconstructed speech signal weighted with the same ear perceptive curve.

18. A non-transitory computer-readable medium comprising software code portions, stored thereon, capable of implementing, when executed on a processing system, the coding method of claim 1.

19. A method for decoding audio data coded according to the coding method of claim 1, comprising:

identifying a class of a frame to be reconstructed based on indices that identify a filter parameter vector in a filter codebook and source parameter vectors in a source codebook that represent samples in the frame and, respectively, in respective subframes of the frame;

identifying the filter and source codebooks associated with the identified class;

identifying the filter parameter vector in the filter codebook and the source parameter vectors in the source codebook identified by the indices; and reconstructing the frame based on the identified filter parameter vector in the filter codebook and on the source parameter vectors in the source codebook.

20. A decoder comprising a processing system and a memory with software code portions stored thereon, the software code portions when executed by the processing system being configured to implement the decoding method of claim 19.

21. A non-transitory computer-readable medium comprising software code portions, stored thereon, capable of implementing, when executed on a processing system, the decoding method of claim 19.

22. A coder, for coding audio data, comprising a processing system and a memory with software code portions stored thereon, the software code portions when executed by the processing system being configured to cause the processing system to:

group data into frames;

classify the frames into classes;

for each class, transform the frames belonging to the class into filter parameter vectors;

for each class, compute a filter codebook based on the filter parameter vectors belonging to the class;

segment each frame into subframes;

for each class, transform the subframes belonging to the class into source parameter vectors, which are extracted from the subframes by applying a filtering transformation based on the filter codebook computed for a corresponding class;

for each class, compute a source codebook based on the source parameter vectors belonging to the class; and code the data based on the computed filter and source codebooks.

23. The coder of claim 22, wherein stretches of a speech signal more frequently used are coded using filter and/or source codebooks with higher cardinality while stretches of a speech signal less frequently used are coded using filter and/or source codebooks with lower cardinality.

24. The coder of claim 22, wherein a first portion of speech signal is pre-processed to create filter and source codebooks, the same filter and source codebooks being used in real-time coding of speech signal having acoustic and phonetic parameters homogeneous with said first portion.

25. The coder of claim 24, wherein said speech signal to be coded is subjected to real-time automatic speech recognition in order to obtain a corresponding phonetic string necessary for coding.

* * * * *